US005102017A

United States Patent [19]

Dirksing

[11] Patent Number: 5,102,017

[45] Date of Patent: Apr. 7, 1992

[54] MECHANICAL ACTUATOR FOR DISPENSING TAP

[75] Inventor: Robert S. Dirksing, Cincinnati, Ohio

[73] Assignee: The Procter & Gamble Company, Cincinnati, Ohio

[21] Appl. No.: 534,783

[22] Filed: Jun. 7, 1990

[51] Int. Cl.[5] ..... B65D 37/00

[52] U.S. Cl. ..... 222/213; 222/509; 222/518

[58] Field of Search ..... 222/509, 518, 212

[56] References Cited

U.S. PATENT DOCUMENTS

| | | | |
|---|---|---|---|
| 2,443,022 | 6/1948 | Berg | 222/387 |
| 3,055,562 | 9/1962 | Jepson | 222/472 |
| 3,138,331 | 6/1964 | Kutik | 222/509 |
| 3,157,787 | 10/1964 | Miller | 222/518 |
| 3,187,965 | 6/1965 | Bourget | 222/518 |
| 3,323,690 | 6/1967 | Monahon | 222/402.13 |
| 3,404,814 | 10/1968 | Wakeman | 222/402.13 |
| 3,460,871 | 8/1969 | Keller et al. | 303/22 |
| 3,582,594 | 6/1971 | Twyford | 200/172 |
| 3,584,834 | 6/1971 | Reid | 222/518 |
| 3,595,445 | 7/1971 | Buford et al. | 222/213 |
| 3,739,941 | 6/1973 | Ostrwosky et al. | 222/402.13 |
| 3,782,602 | 1/1974 | Page | 222/518 |
| 4,033,487 | 7/1977 | Micallef | 222/207 |
| 4,416,395 | 11/1983 | Gaubert | 222/83 |
| 4,452,425 | 6/1984 | Lucking | 251/144 |
| 4,471,807 | 9/1984 | Lucking et al. | 137/614.19 |
| 4,513,771 | 4/1985 | Thomas et al. | 137/315 |
| 4,589,577 | 5/1986 | Welsh et al. | 222/518 |
| 4,621,750 | 11/1986 | Roethel | 222/505 |
| 4,640,493 | 2/1987 | Dudzik | 251/342 |
| 4,645,100 | 2/1987 | Wells | 222/505 |
| 4,660,748 | 4/1987 | Hagan | 222/509 |
| 4,664,297 | 5/1987 | Giovinazzi | 222/185 |
| 4,687,123 | 8/1987 | Hyde | 222/518 |
| 4,693,400 | 9/1987 | Frahm et al. | 222/518 |
| 4,711,376 | 12/1987 | Manfroni | 222/509 |
| 4,848,600 | 7/1989 | Dark | 222/498 |
| 4,905,875 | 3/1990 | Straiton | 222/505 |

FOREIGN PATENT DOCUMENTS

| | | | |
|---|---|---|---|
| 240764 | 1/1946 | Switzerland | 222/509 |

*Primary Examiner*—Michael S. Huppert
*Assistant Examiner*—Kenneth Bomberg
*Attorney, Agent, or Firm*—E. Kelly Linman; Richard C. Witte; Thomas H. O'Flaherty

[57] ABSTRACT

A mechanical actuator for liquid dispensing taps which provides a mechanical advantage by means of a combination of levers, linkages, and sets of floating and fixed hinges. In a preferred embodiment the actuator improves the ergonomics of using the dispensing tap by providing a more natural hand position and better visibility of the product flow from liquid dispensing taps typically used on large volume liquid containers such as bag-in-box packages.

20 Claims, 6 Drawing Sheets

MECHANICAL ACTUATOR FOR DISPENSING TAP

BACKGROUND OF THE INVENTION

1. Field of the Invention

The present invention relates to mechanical actuators for liquid dispensing taps such as are commonly used on bag-in-box style packages. The mechanical actuators are comprised of levers, linkages, and hinges which, in combination, modify the force required to open the liquid dispensing tap. Such mechanical actuators require less actuating force and provide better flow control to the users of said liquid dispensing taps when compared to similar liquid dispensing taps without said mechanical actuators. Furthermore, for a given mechanical advantage, mechanical actuators of the present invention permit locating the primary pivots of the levers in positions which minimize the extension of the levers beyond the general outline of the dispensing tap. This reduces the bending moment applied to the dispensing tap at its mounting when the levers are actuated to open the tap.

2. Description of the Prior Art

Inexpensive dispensing taps are currently used to dispense many different liquids, such as, wine, water, and laundry products. Although not exclusively, these dispensing taps are commonly associated with packages comprised of plastic liners disposed within supporting paperboard containers often referred to as bag-in-box packages.

Bag-in-box packages typically contain three or more liters of liquid product, makes handling and pouring cumbersome. Consequently, many taps which can dispense liquid product by gravity upon demand have been developed. For example, U.S. Pat. No. 4,452,425 issued to Lucking on June 5, 1984, which is hereby incorporated herein by reference, discloses a plastic diaphragm tap employing a domed resilient diaphragm which must he pressed and deformed downward to unseat a valve for dispensing. Release of pressure from the resilient diaphragm permits the diaphragm to regain is original shape and close the valve. However, the user must overcome the resilience of the diaphragm with a single finger or thumb while his or her hand is in a rather uncomfortable position.

U.S. Pat. No. 4,640,493 issued to Dudzik on Feb. 3, 1987, which is hereby incorporated herein by reference, discloses another dispensing tap for a liquid container which also employs a resilient diaphragm, hut further includes two simple levers to help overcome the resilience of the dome and improve the ergonomics, i.e., the user's hand position while operating.

OBJECTS OF THE INVENTION

Accordingly, it is the object of the present invention to provide an improved mechanical actuator for operating liquid dispensing tap that will: (1) reduce the force required to open the tap by the user; (2) provide a more natural hand position during operation and (3) improve the control and visibility of the flow of the liquid from the dispensing tap.

SUMMARY OF THE INVENTION

In a particularly preferred embodiment, the present invention comprises a dispensing tap actuator which includes a lever having one end attached to he liquid dispensing tap by means of a fixed pivot and its other end joined to a linkage by means of a movable hinge. The linkage in turn is further engaged by the diaphragm in the liquid dispensing tap so that external forces applied to the actuator will cause the tap valve to open and thereby permit dispensing of the material contained within the package.

BRIEF DESCRIPTION OF THE DRAWINGS

While the specification concludes with claims particularly pointing out and distinctly claiming the present invention, it is believed that the invention will be understood from the following description in conjunction with the accompanying drawings in which:

DESCRIPTION OF THE PREFERRED EMBODIMENTS

Figure 1:
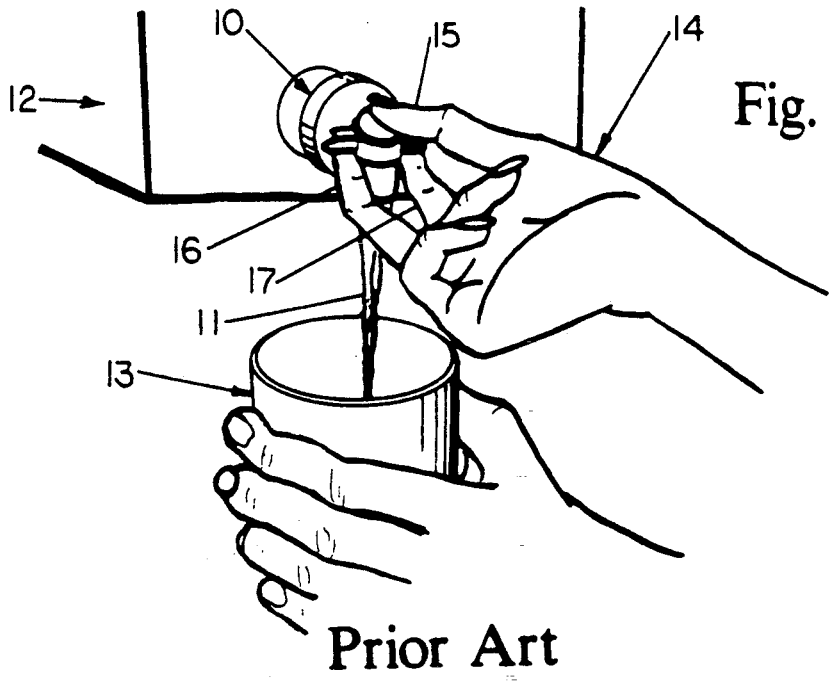
Fig. 1 Prior Art
FIG. 1 is a simplified pictorial view of the operation of a diaphragm liquid dispensing tap of the prior art, as generally disclosed in U.S. Pat. No. 4,452,425.

In FIG. 1 a typical prior art style resilient diaphragm tap 10 is shown dispensing a liquid product 11 from product container 12 into a measuring cup 13. Dispensing liquids from such prior art style taps is not only awkward, but also provides poor visibility of the liquid being dispensed due to the position of the user's hand.

Note particularly the inverted hand 4 and forced arrangement of the thumb 15 and fingers 16 and 17 necessary to depress the diaphragm. Note also that the position of the user's hand obstructs the view of the dispensed liquid product 11 and the measuring cup 13.

Figure 2:
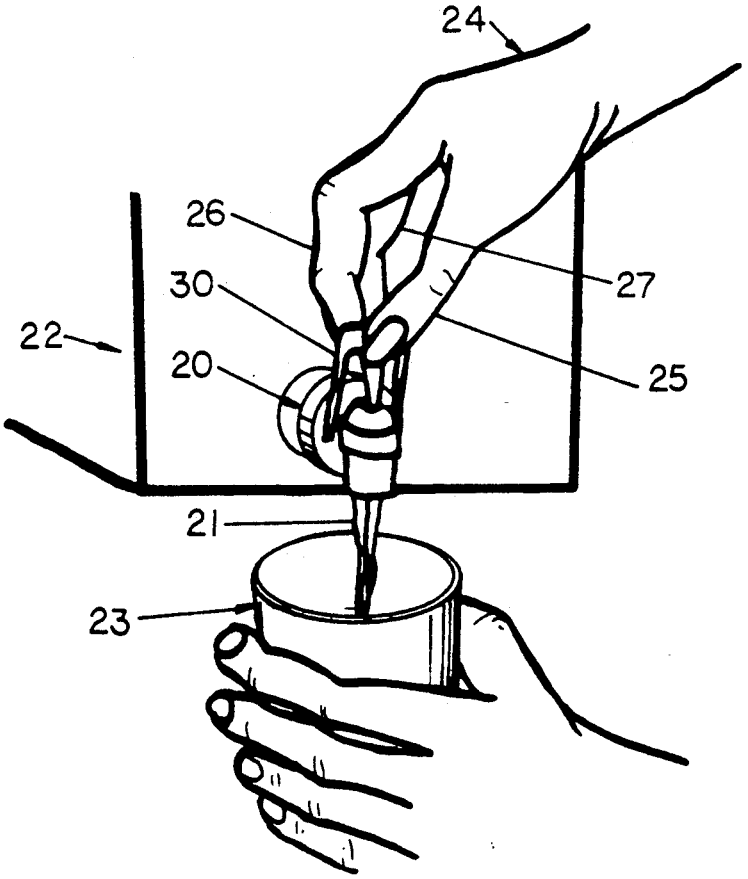
FIG. 2 is a simplified pictorial view of the operation of a diaphragm liquid dispensing tap of the type generally shown in FIG. 1, but which includes a first embodiment of a mechanical tap actuator of the present invention.

In FIG. 2 a mechanical tap actuator 30 of the present invention is attached a resilient diaphragm tap 20, which can be generally similar to diaphragm tap 10 shown in FIG. 1 and which is shown dispensing liquid product 21 from product container 22 into a measuring cup 23. As can be seen in FIG. 2, the mechanical tap actuator 30 of the present invention permits a more natural position of the user's hand 24 and a more comfortable opposing arrangement of the thumb 25 and fingers 26 and 27 while the tap actuator 30 is held in the "on" position. Note also that the position of the user's hand does not obstruct the view of the dispensed liquid product 21 and the measuring cup 23.

Figure 3A:
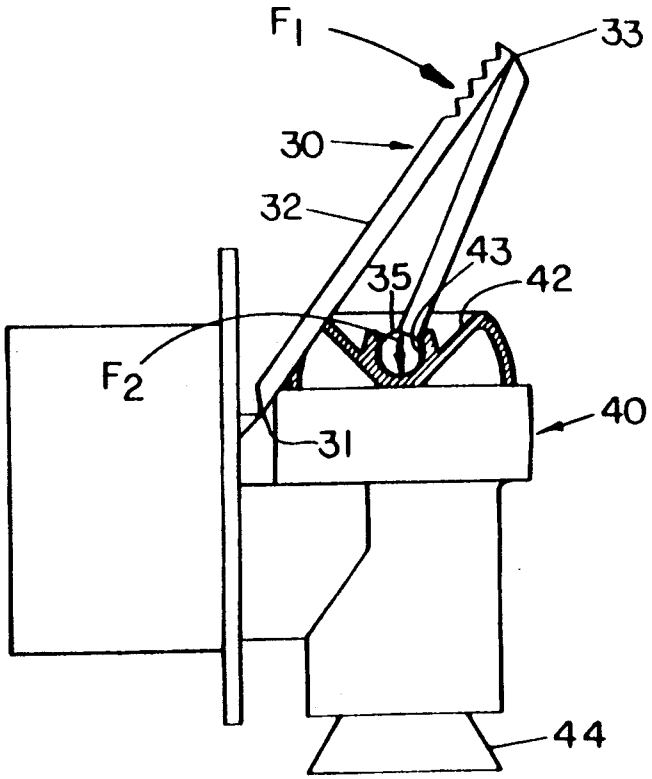
FIG. 3A is a simplified view of the tap and mechanical actuator shown in FIG. 3 with the tap valve in its open position.
Figure 3:
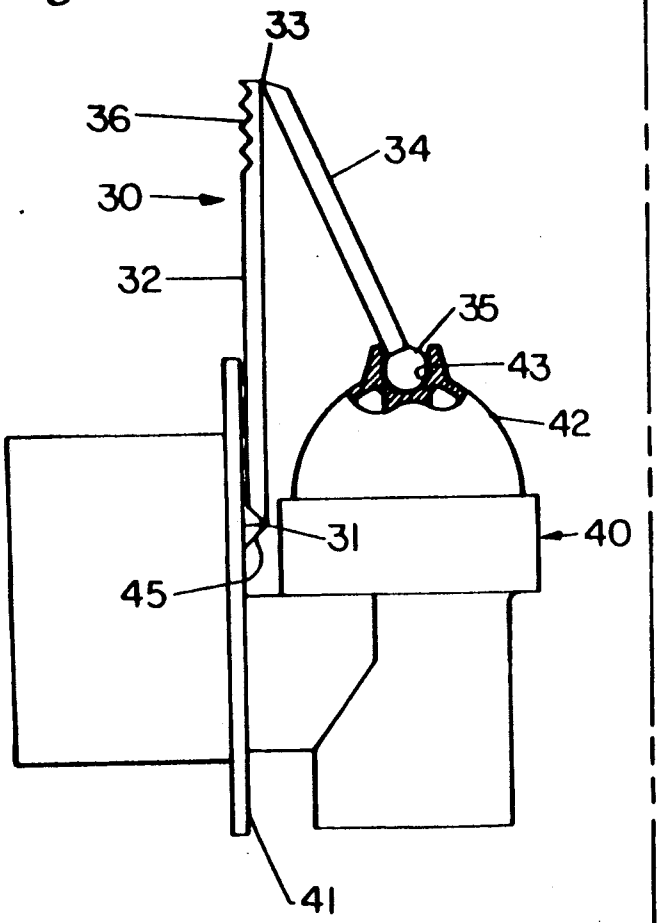
FIG. 3 is a simplified side view of a diaphragm liquid dispensing tap of the type generally shown in FIG. 2 with its valve in its closed position, said view having been partially sectioned through the tap diaphragm, said tap incorporating a mechanical tap actuator of the type generally shown in FIG. 2.

FIG. 3 discloses a mechanical tap actuator 30 of the present invention in greater detail. The actuator 30 is secured to a diaphragm dispensing tap 40. Mechanical tap actuator 30 preferably includes a fixed pivot or hinge 31, a lever 32, a moveable or floating hinge 33, a link 34, and a movable pivot 35. In the embodiment disclosed in FIG. 3, lever 32 of tap actuator 30 is attached integrally to a hinge boss 45 on flange 41. Link 34 is preferably integrally joined to lever 32 by means of a moveable or floating hinge 33. Link 34 is preferably mechanically attached to resilient diaphragm 42 by means of a moveable pivot 35 nested within a socket 43. Surface 36 on lever 32 is preferably serrated to provide an increase in friction between the lever and the user's fingers.

In FIG. 3A diaphragm dispensing tap 40 is shown in its "open" or "on" position, with valve element 44 moved away from its seat. Valve element 44 is connected to the top interior of resilient diaphragm 42 so that when the top of said resilient diaphragm 42 is reflected downward, valve element 44 is caused to move away from its seat.

In operation, force "$F_1$" is applied by the user's fingers to the top of lever 32 at serrated surface 36. This force "$F_1$" causes lever 32 to rotate about its fixed pivot or hinge 31. Consequently, moveable or floating hinge 33 travels in an arc about fixed hinge 31, applying a substantially vertical force on link 34 which in turn is transmitted onto pivot 35. Movable pivot 35 in turn applies a substantially vertical force "$F_2$" to socket 43 in resilient diaphragm 42, thereby causing resilient diaphragm 42 to reflect downwardly. This unseats valve 44 and opens the tap 40.

Because a rather large displacement of the upper end of lever 32 results in a relatively small displacement of moveable pivot 35 in socket 43 of resilient diaphragm 42, a substantial mechanical advantage is realized. In other words, tap actuator 30 not only provides a more comfortable hand position during actuation, but in addition provides a compact means of reducing the amount of force "$F_1$" which must be applied by the user to control product flow.

Figure 3C:
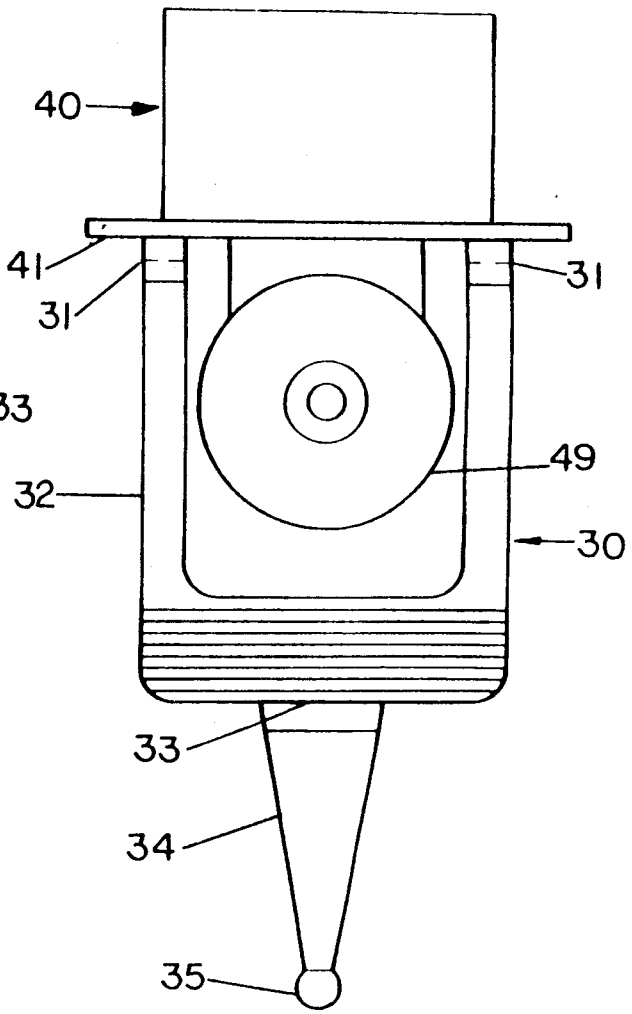
FIG. 3C is a simplified top view of the diaphragm liquid dispensing tap and mechanical actuator shown in FIG. 3 with the tap valve in its closed position and the linkage of the mechanical actuator in an unfolded condition.
Figure 3B:
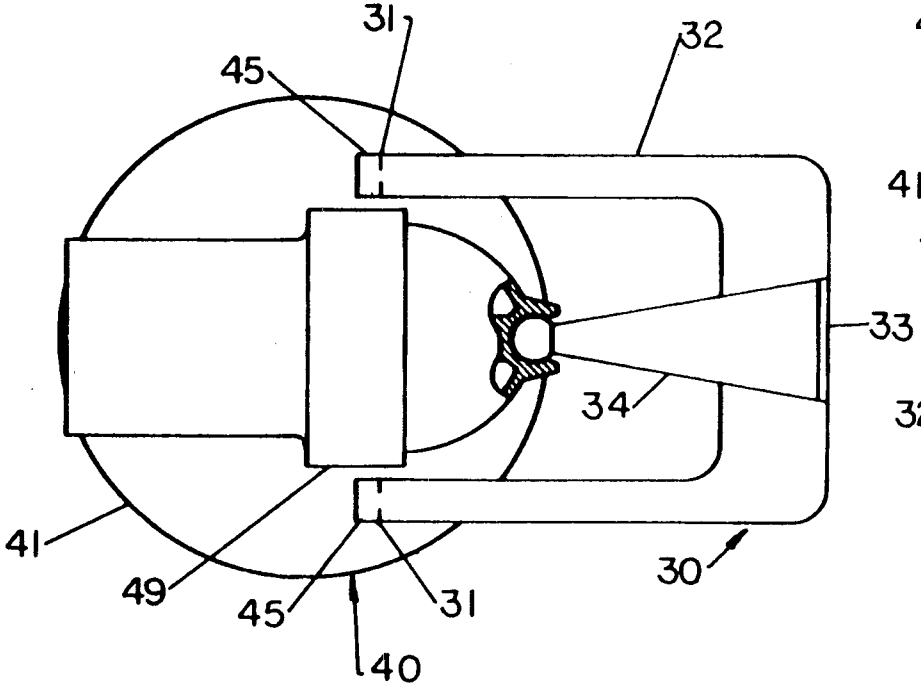
FIG. 3B is a simplified front view of the diaphragm liquid dispensing tap shown in FIG. 3 taken along view line 3B—3B in FIG. 3 with its valve in the closed position, said view having been partially sectioned through the tap diaphragm.

FIG. 3B is a front view of tap actuator 30 and tap 40 taken along view line 3B—3B of FIG. 3. In a particularly preferred embodiment of the present invention, lever 32 comprises a yoke that straddles the body portion 49 of tap 40. Fixed pivot or hinge 31 is discontinuous and joins lever 32 to a pair of horizontally aligned hinge bosses 45 on tap flange 41. Link 34 is joined to lever 32 by means of a moveable or floating hinge 33.

FIG. 3C is a top view of tap actuator 30 and tap 40 with tap actuator 30 shown in an unfolded condition. In its unfolded condition, lever 32 extends perpendicularly from tap flange 41 about fixed pivot or hinge 31. Furthermore, link 34 is unfolded about moveable or floating hinge 33 and extends generally in the same plane as lever 32. Those skilled in the art of plastic injection molding will appreciate that dispensing tap 40 and mechanical tap actuator 30 can be integrally molded in the condition illustrated in FIG. 3C and thereafter folded into the operational position illustrated in FIG. 3 by engaging moveable pivot 35 within resilient diaphragm socket 43, as by means of a snap-in detent.

Figure 4:
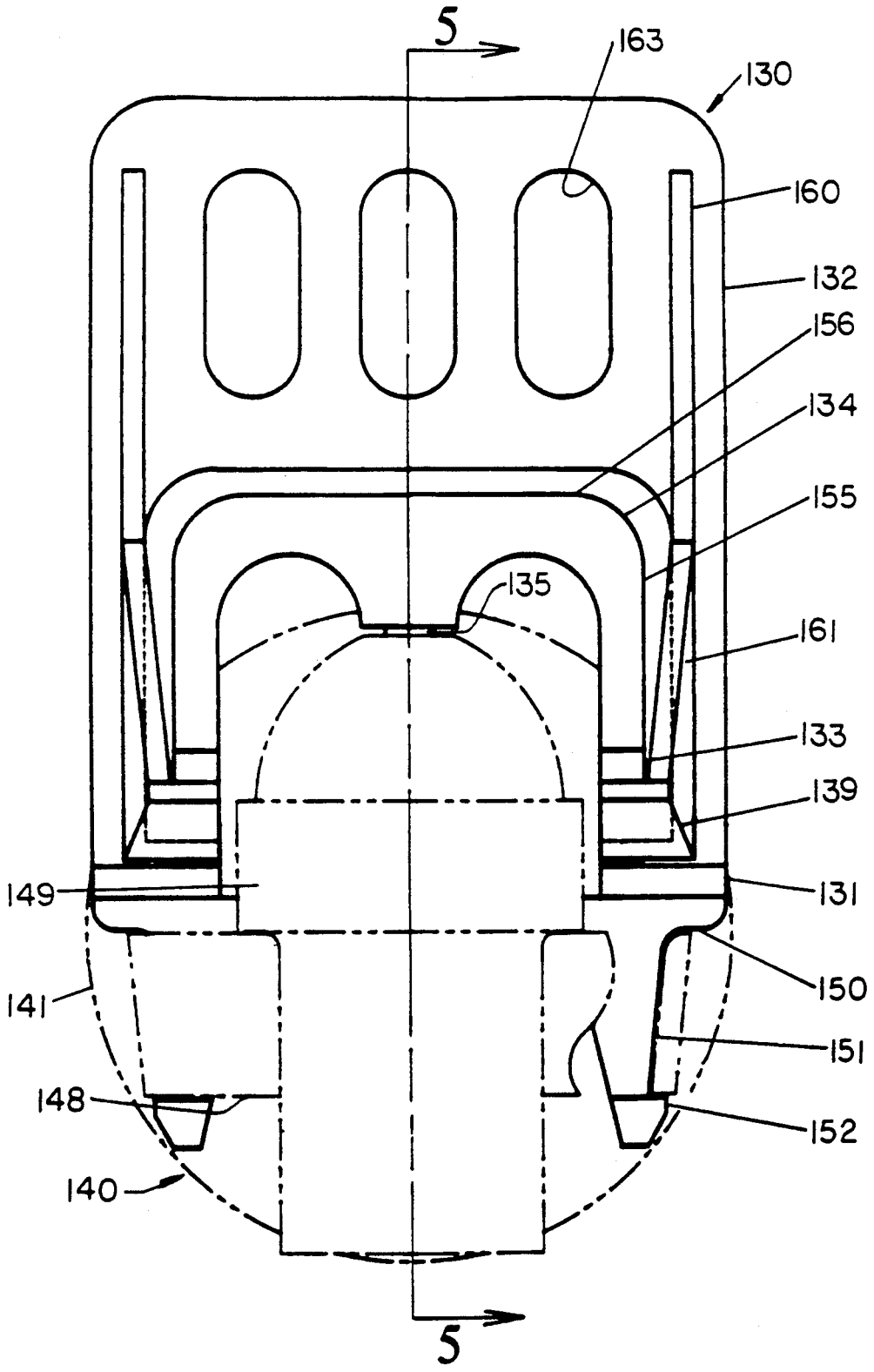
FIG. 4 is a front view of a second embodiment of a mechanical actuator of the present invention to a diaphragm liquid dispensing tap which has been shown in phantom.

FIG. 4 discloses an alternative mechanical tap actuator embodiment 130 of the present invention. Tap actuator embodiment 130 is comprised of a fixed pivot or hinge 131, a first or upper lever 132, a pair of second or lower levers 139, a pair of horizontally aligned moveable or floating hinges 133, a link 134, and a moveable pivot 135. In a particularly preferred embodiment, mechanical tap actuator 130 further includes a hinge bar 150 and a pair of tangs 151 each terminating with latches 152. Upper lever 132 is preferably in the general form of a yoke which straddles link 134 and body portion 149 of diaphragm dispensing tap 140. Upper lever 132 preferably includes openings 163 which provide increased finger friction with the upper lever 132 and reduce the total quantity of plastic required for fabrication. Upper lever 132 also preferably includes ribs 160 and gussets 161 which stiffen the upper lever 132 and its junctures with lower levers 139. Link 134 includes a pair of connectors 155, a crossbar 156, and a moveable pivot 135.

In the particular embodiment illustrated in FIG. 4, mechanical tap actuator 130 is attached to diaphragm dispensing tap 140, shown only in phantom, by means of a mechanical latch. To assemble tap actuator 130 onto dispensing tap 140, latches 152 are inserted into receiving channels 148 which are preferably integrally molded onto the flange 141 of tap 140. interference between the latches 152 and the outer interior walls of channels 148 cause tangs 151 to deflect inwardly until latches 152 project fully beneath the lower edge of channels 148, whereupon latches 151 spring outwardly thereby releasably securing the tap actuator 130 onto the tap 140.

Figure 5A:
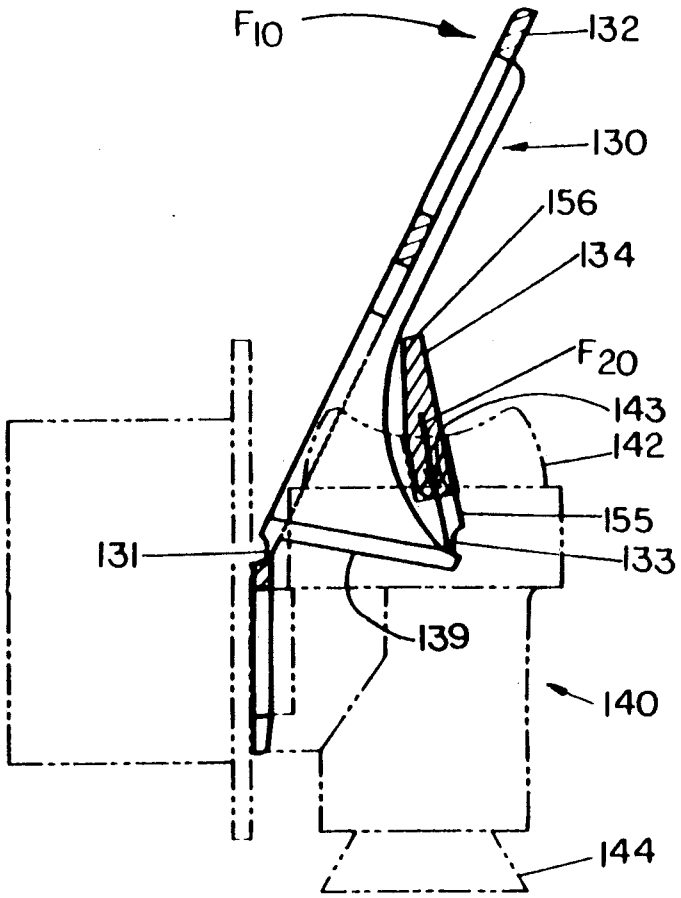
FIG. 5A is a view of the mechanical actuator embodiment shown in FIG. 5 with its valve in its open position.
Figure 5:
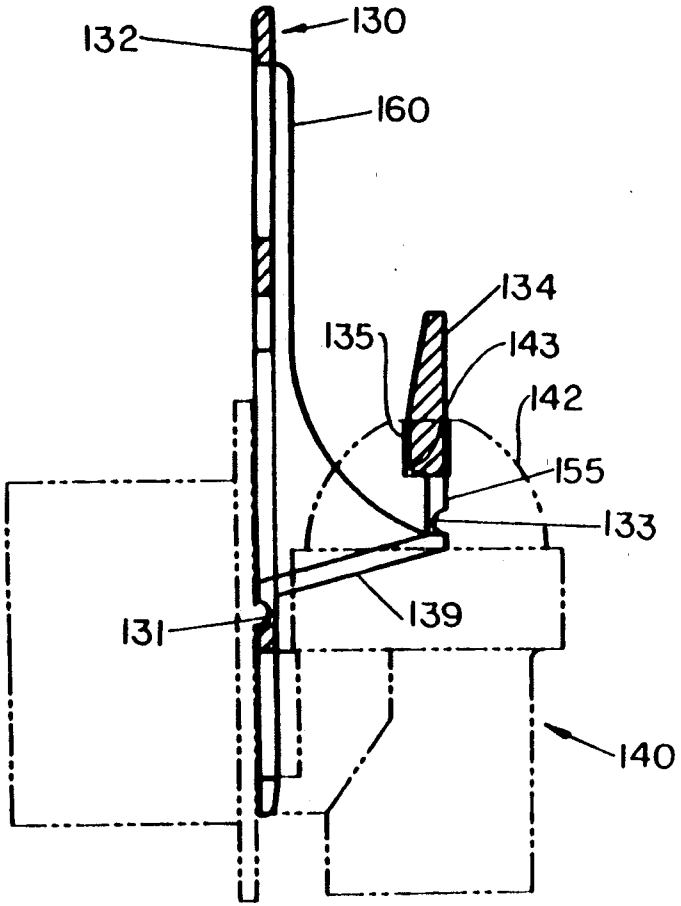
FIG. 5 is a cross-sectional view of the mechanical actuator embodiment shown in FIG. 4 with the valve of the liquid dispensing tap in its closed position, said view being taken along section line 5—5 in FIG. 4.

Tap 140 and tap actuator 130 are illustrated in the "closed" or "off" position in FIG. 5. Resilient diaphragm 142 of dispensing tap 140 is in the general form of a dome. Moveable pivot 135 is engaged in a socket 143 in resilient diaphragm 142.

In operation, an external force "$F_{10}$" is applied by the fingers of the user to the top portions of the upper lever 132 in the direction shown by the arrow. This force "$F_{10}$" causes upper lever 132 to rotate about its fixed or hinge 13 as illustrated in FIG. 5A. Consequently, the exposed ends of lower levers 139 also rotate about the fixed pivot or hinge 131. Thus force "$F_{10}$" to lever 132 is transmitted via the exposed ends of lower levers 139 through moveable or floating hinges 133 onto the yoke-shaped link 134, which is comprised of a pair of connectors 155 having their free ends connected to hinges 133 and their opposite ends secured to a crossbar 156. The yoke-shaped link 134 further includes a centrally located moveable pivot 135, which apples a force "$F_{20}$" to socket 43 in resilient diaphragm 142. The applied force "$F_{20}$" causes resilient diaphragm 142 to resiliently deform, thus causing valve element 144 to move away from its seat and thereby open dispensing tap 140. Because a rather large displacement of the upper end of upper lever 132 results in a relatively small displacement of moveable pivot 135, a substantial mechanical advantage is also realized with the mechanical actuator embodiment 130 disclosed in FIG. 5A. This in turn minimizes the magnitude force "$F_{10}$" which must be applied to dispense liquid from the tap.

Figure 6:
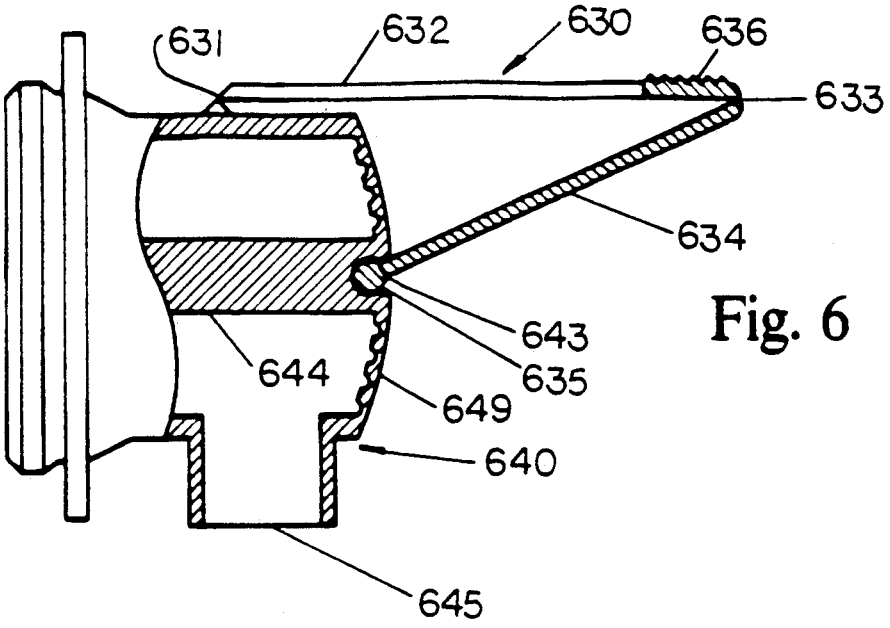
FIG. 6 is a partial cross-sectional view of an alternative diaphragm liquid dispensing tap incorporating another mechanical actuator embodiment of the present invention.

Still another mechanical tap actuator embodiment 630 of the present invention is illustrated in FIG. 6. Tap actuator 630 includes a fixed pivot or hinge 631, a lever 635, a moveable or floating hinge 633, a link 634, and a moveable pivot 635. Moveable pivot 635 nests in a socket 643 in resilient diaphragm 649. Resilient diaphragm 649 is integrally attached to a horizontally mounted valve element 644. Unlike the dispensing tap embodiments disclosed earlier herein, the discharge opening 645 of tap 640 is generally perpendicular to the axis of valve element 644.

Figure 7:
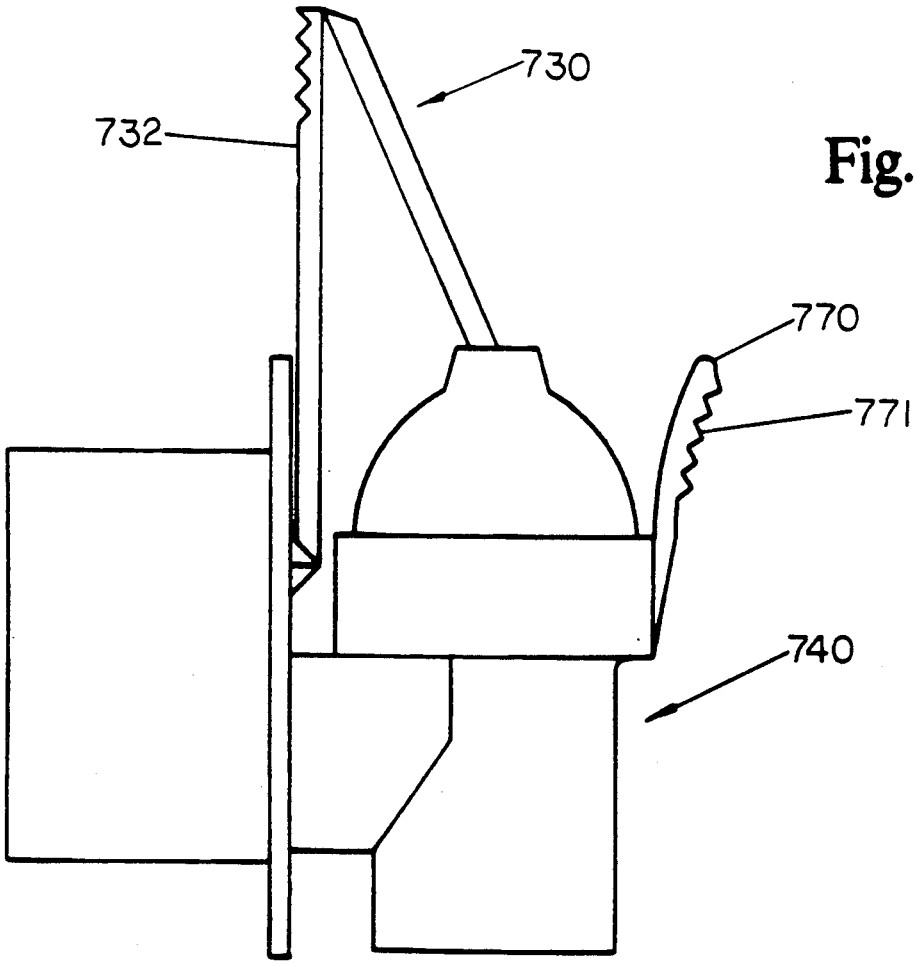
FIG. 7 is a side view of a diaphragm liquid dispensing tap incorporating a mechanical actuator embodiment of the type generally shown in FIG. 3, but further including an opposed gripping tab.

FIG. 7 discloses still another mechanical tap actuator embodiment 730 of the present invention. Mechanical tap actuator embodiment 730 attached to dispensing tap 740 which includes an opposing member 770 which can he used to aid in gripping the actuating lever 732 with opposing fingers. Opposing member 770 preferably includes a serrated surface 771 to increase the degree of friction with the user's fingers. In operation, opposing member 770 can be used in conjunction with tap actuating lever 732 to permit a pinching action between said opposing member 770 and tap actuating lever 732. This modification is especially useful when the liquid contents in the attached package are nearly exhausted, since insufficient package weight may cause shifting of the entire package if an unbalanced force is applied to the tap actuating lever 732.

While particular embodiments of the present invention have been illustrated and described, it will be obvious to those skilled in the art that various changes and modifications can be made without departing from the spirit and scope of the present invention, and it is intended to cover in the appended claims all such modifications that are within the scope of this invention.

What is claimed is:

1. An easily manually actuated liquid dispensing tap for a container holding a liquid substance, said tap having a normally closed position which prevents liquid flow therethrough and an open position which permits liquid to be dispensed from said container and which can only be maintained so long as a manual gripping force is applied to said dispensing tap, said tap comprising:

(a) hollow body means having an inlet port which is placed in fluid communication with the liquid substance in said container when said tap is in use, an outlet port oriented substantially perpendicular to said inlet port, said outlet port providing an exit way from said tap for said liquid substance, and a diaphragm port located substantially opposite at least one of said inlet or said outlet ports;

(b) resilient diaphragm means closing said diaphragm port in said hollow body to prevent the passage of said liquid substance through said diaphragm port;

(c) valve closure means in operative engagement with said resilient diaphragm means for closing a passageway between said inlet port and said outlet port when said resilient diaphragm means is in an undeformed condition;

(d) mechanical actuator means for deforming said resilient diaphragm means to hereby open said passageway between said inlet port and said outlet port to dispense said liquid substance whenever a manual gripping force is applied to said mechanical actuator means, said mechanical actuator means comprising an actuating lever for gripping by the user's fingers, said actuating lever having one end hingedly connected to a fixed pivot point located on said liquid dispensing tap and its other end connected to a floating hinge, said floating hinge also being connected to one end of a link member, the opposite end of said link member including a moveable pivot point which is rotatably secured to said resilient diaphragm means by a snap-in detent, whereby a sufficient gripping force applied to said floating hinged end of said actuating lever will be transmitted to and will deform said resilient diaphragm means via said link member.

2. The easily manually actuated liquid dispensing tap of claim 1, wherein said link member is shorter in overall length than said actuating lever.

3. The easily manually actuated dispensing tap of claim 2, wherein said actuating lever comprises a yoke which spans said resilient diaphragm means and wherein said fixed pivot point on said liquid dispensing tap is discontinuous and comprises at least two discrete connectors which are separated from one another but which are located along a common axis of rotation, whereby each branch of said yoke is hingedly connected to one of said connectors.

4. The easily manually actuated liquid dispensing tap of claim 1, wherein said actuating lever includes an irregular surface to increase its surface friction with the user's gripping fingers.

5. The easily manually actuated liquid dispensing tap of claim 4, wherein said irregular surface comprises a multiplicity of serrations.

6. The easily manually actuated liquid dispensing tap of claim 2, wherein said fixed pivot point to which one end of said actuating lever is hingedly secured is located below said resilient diaphragm means to permit said actuating lever to be of a greater overall length than said link member.

7. The easily manually actuated liquid dispensing tap of claim 1, wherein said resilient diaphragm port is located opposite said outlet port of said hollow body and wherein said valve closure means closes said outlet port when said resilient diaphragm means is in its undeformed condition.

8. The easily manually actuated liquid dispensing tap of claim 1, wherein said resilient diaphragm means is comprised of molded rubber.

9. The easily manually actuated liquid dispensing tap of claim 1, wherein all of the elements comprising said easily manually actuated dispensing tap are molded as an integral unit from polymeric material and thereafter folded into an operative position.

10. The easily manually actuated dispensing tap of claim 1, wherein said actuator means for deforming said resilient diaphragm means is releasably secured to said dispensing tap.

11. An easily manually actuated liquid dispensing tap for a container holding a liquid substance, said tap having a normally closed position which prevents liquid flow therethrough and an open position which permits liquid to be dispensed from said container and which can only be maintained so long as a manual gripping force is applied to said dispensing tap, said tap comprising:

(a) hollow body means having an inlet port which is placed in fluid communication with the liquid substance in said container when said tap is in use, an outlet port oriented substantially perpendicular to said inlet port, said outlet port providing an exit way from said tap for said liquid substance, and a diaphragm port located substantially opposite at least one of said inlet or said outlet ports;

(b) resilient diaphragm means closing said diaphragm port in said hollow body to prevent the passage of said liquid substance through said diaphragm port;

(c) valve closure means in operative engagement with said resilient diaphragm means for closing a passageway between said inlet port and said outlet port when said resilient diaphragm means is in a undeformed condition;

(d) mechanical actuator means for deforming said resilient diaphragm means to thereby open said passageway between said inlet port and said outlet port to dispense said liquid substance whenever a manual gripping force is applied to said mechanical actuator means, said mechanical actuator means comprising an actuating lever for gripping by the user's fingers, said actuating lever having one end hingedly connected to a fixed pivot point located on said liquid dispensing tap and its other end connected to a floating hinge, said floating hinge also being connected to one end of a link member, the opposite end of said link member including a moveable pivot point which is rotatably secured to said resilient diaphragm means; and (e) a fixed gripping member secured to said dispensing tap approximately opposite said actuating lever on said mechanical actuator means to permit squeezing of said actuating lever and said fixed gripping member between the user's fingers.

12. An easily manually actuated liquid dispensing tap for a container holding a liquid substance, said tap having a normally closed position which prevents liquid flow therethrough and an open position which permits liquid to he dispensed from said container and which can only be maintained so long as a manual gripping force is applied to said dispensing tap, said tap comprising:

(a) hollow body means having an inlet port which is placed in fluid communication with the liquid substance in said container when said tap is in use, an outlet port oriented substantially perpendicular to said inlet port, said outlet port providing an exit way from said tap for said liquid substance, and a diaphragm port located substantially opposite at least one of said inlet or said outlet ports;

(b) resilient diaphragm means closing said diaphragm port in said hollow body to prevent the passage of said liquid substance through said diaphragm port;

(c) valve closure means in operative engagement with said resilient diaphragm means for closing a passageway between said inlet port and said outlet port when said resilient diaphragm means is in an undeformed condition;

(d) mechanical actuator means for deforming said resilient diaphragm means to thereby open sad passageway between said inlet port and said outlet port to dispense said liquid substance whenever a manual gripping force is applied to said mechanical actuator means, said mechanical actuator means comprising a first lever for gripping by the user's fingers and a pair of second levers secured to and extending in a direction generally perpendicular to said first lever, said first lever having one end hingedly connected to a fixed pivot point located on said liquid dispensing tap, said second levers having their exposed ends connected to a pair of floating hinges, said floating hinges also being connected to the free ends of yoke-shaped link member which straddles said resilient diaphragm means, the central portion of the opposite end of said yoke-shaped link member including a moveable pivot point which rotatably secured to said resilient diaphragm means, whereby a sufficient gripping force applied to said first lever will be transmitted to and will deform said resilient diaphragm means via said yoke-shaped link member.

13. The easily manually actuated liquid dispensing tap of claim 12, wherein said moveable pivot point on said yoke-shaped link member is rotatably secured to said resilient diaphragm means by a snap-in detent.

14. The easily manually actuated liquid dispensing tap of claim 12, wherein said second levers are shorter in overall length than said first lever.

15. The easily manually actuated dispensing tap of claim 14, wherein said first lever comprises a yoke which spans said resilient diaphragm means and wherein said fixed pivot point on said liquid dispensing tap is discontinuous and comprises at least two discrete connectors which are separated from one another but which are connected along a common axis of rotation, whereby each branch of said yoke is hingedly connected to one of said connectors.

16. The easily manually actuated liquid dispensing tap of claim 12, wherein said first lever includes at least one aperture therein to increase its surface friction with the user's gripping fingers.

17. The easily manually actuated liquid dispensing tap of claim 12, wherein said resilient diaphragm port is located opposite said outlet port of said hollow body and wherein said valve closure means closes said outlet port when said diaphragm means is in its undeformed condition.

18. The easily manually actuated liquid dispensing tap of claim 12, said liquid dispensing tap further including a fixed gripping member secured to said dispensing tap approximately opposite said first lever on said mechanical actuator means to permit squeezing of said first lever and said fixed gripping member between the user's fingers to dispense liquid from said container.

19. The easily manually actuated liquid dispensing tap of claim 12, wherein said resilient diaphragm means is comprised of molded rubber.

20. The easily manually actuated liquid dispensing tap of claim 12, wherein said actuator means for deforming said resilient diaphragm means is releasably secured to said dispensing tap.

* * * * *

UNITED STATES PATENT AND TRADEMARK OFFICE

CERTIFICATE OF CORRECTION

PATENT NO. : 5,102,017

DATED : April 7, 1992

INVENTOR(S) : Robert S. Dirksing

It is certified that error appears in the above-identified patent and that said Letters Patent is hereby corrected as shown below:

Column 1, line 33, after "product," insert -- which -- .
Column 1, line 42, "is" should read -- its -- .
Column 1, line 50, "hut" should read -- but -- .
Column 1, line 67, "he" should read -- the -- .
Column 2, line 43, after "invention" insert -- attached -- .
Column 3, line 1, "4" should read -- 14 -- .
Column 3, line 7, after "attached" insert -- to -- .
Column 4, line 55, after "fixed" insert -- pivot -- .
Column 4, line 58, after "$F_{10}$" insert -- applied -- .
Column 4, line 66, "43" should read -- 143 -- .
Column 5, line 12, "635" should read -- 632 -- .
Column 5, line 22, after "730" insert -- is -- .
Column 6, line 2, "hereby" should read -- thereby -- .
Column 7, line 17, "a" should read -- an -- .
Column 8, line 2, "sad" should read -- said -- .
Column 8, line 19, after "which" insert -- is -- .

Signed and Sealed this

Fifteenth Day of June, 1993

*Attest:*

*Attesting Officer*

Michael K. Kirk

MICHAEL K. KIRK

*Acting Commissioner of Patents and Trademarks*